US005145237A

United States Patent [19]

Schulz et al.

[11] Patent Number: 5,145,237

[45] Date of Patent: Sep. 8, 1992

[54] CUTTER BIT WITH OPTIMIZED SHANK

[75] Inventors: Reinhard Schulz; Axel Neukirchen, both of München; Josef Obermeier, Peiting, all of Fed. Rep. of Germany

[73] Assignee: Hilti Aktiengesellschaft, Fürstentum

[21] Appl. No.: 736,713

[22] Filed: Jul. 26, 1991

[30] Foreign Application Priority Data

Aug. 3, 1990 [DE] Fed. Rep. of Germany ..... 4024650

[51] Int. Cl.[5] ..... E21B 10/36

[52] U.S. Cl. ..... 299/94; 125/40; 175/414

[58] Field of Search ..... 299/69, 94; 175/414; 125/40, 43; 30/168, 277

[56] References Cited

U.S. PATENT DOCUMENTS 2,557,195 6/1951 Neamand ..... 299/94
2,629,588 2/1953 Neamand ..... 125/40

FOREIGN PATENT DOCUMENTS 524426 12/1953 Belgium ..... 299/94
1073410 1/1960 Fed. Rep. of Germany .

*Primary Examiner*—David J. Bagnell
*Attorney, Agent, or Firm*—Anderson Kill & Olick

[57] ABSTRACT

An axially extending cutter bit has a shank extending between a trailing end (2, 7) arranged to be inserted into a tool chuck and a leading or working end (5, 8) with the shank between the trailing end and leading end being divided into a first section proceeding from the trailing end and a second section proceeding from the first section to the leading end. The second section is stepped inwardly from the first section. As a result, the energy throughput in passing shock waves is improved and higher material removal rates by the leading or working end are achieved.

8 Claims, 1 Drawing Sheet

Fig. 1
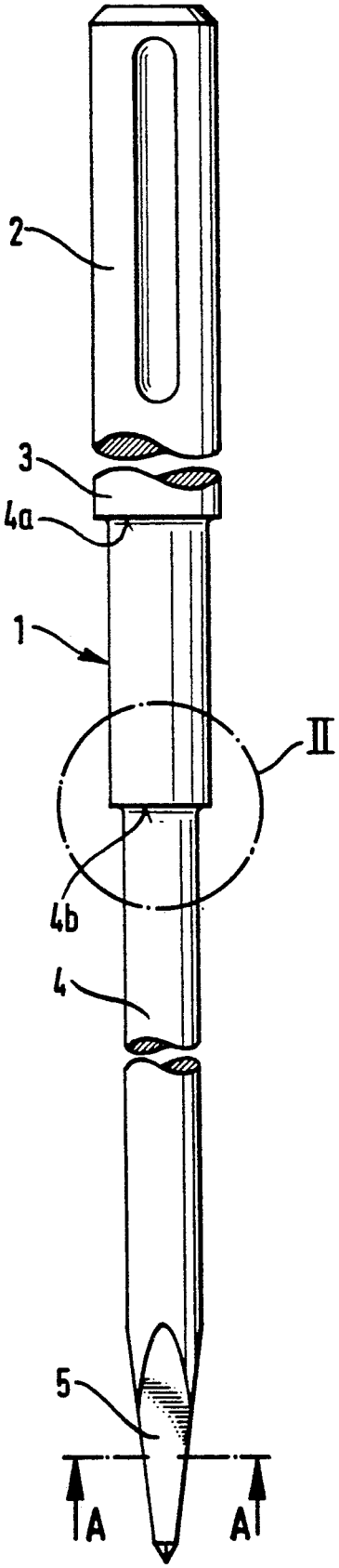
Fig. 2
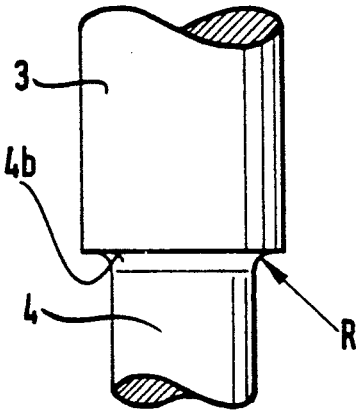
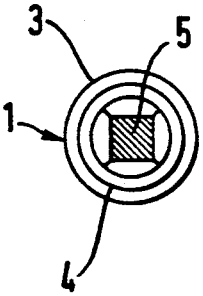
Fig. 4
Fig. 3
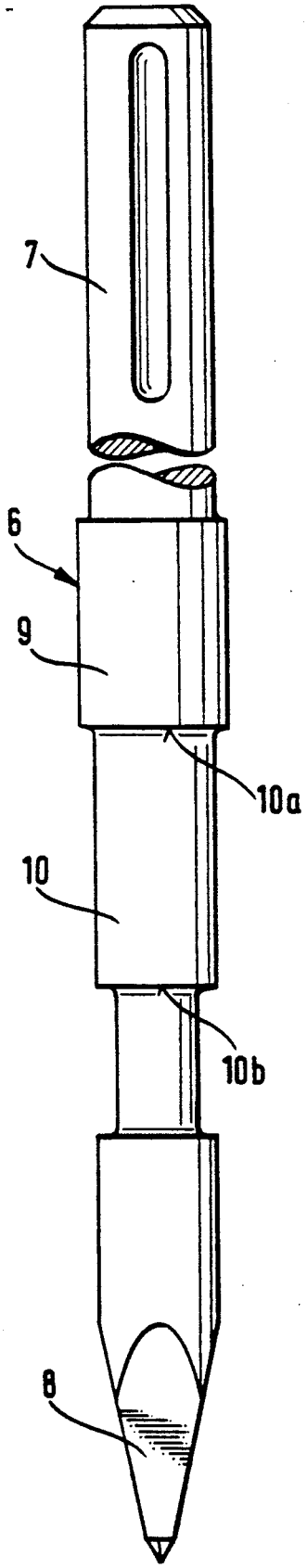

CUTTER BIT WITH OPTIMIZED SHANK

BACKGROUND OF THE INVENTION

The present invention is directed to a cutter bit or chisel bit, hereinafter a cutter bit. The bit has a leading or working end and a trailing end. The trailing end is arranged to be inserted into a tool chuck, such as in a hammerdrill and the like. The leading end is a cutting member. A shank extends between the leading and trailing ends. The shank has a first axially extending section of constant cross section extending from the grailing end and a second axially extending section of diminishing cross-section extending from the first section to the leading end.

Generally with chisel cutters, the shank between the trailingend and the leading end, that is the bit end, is cylindridal. A cutter is disclosed in DE-OS 1 073 410, where the shank tapers conically toward the leading end.

The disadvantage in both instances is that in shock wave-like loading, the energy expended is not optimally utilized and, therefore, the output at the cutter tip is not completely attained.

SUMMARY OF THE INVENTION

Therefore, the primary object of the present invention is to provide a shank for the cutter bit where the energy flow during passing shock waves is adapted to the special conditions of the cutter bit.

In accordance with the present invention, the second section of the shank is reduced in cross section between the first section and the leading or working end.

Due to the cross-sectional changes afforded in accordance with the present invention, the energy throughput with passing shock waves is effected at stepped portions of the second section and the removal rate and down time of the cutter bit is improved as compared to entirely cylindrical and conical sections extending between the trailing end and the leading end.

An optimum effect on the shock waves is achieved if in an advantageous manner partial sections of the second section adjoining the steps have a constant cross-section.

Preferably, the smaller cross-section of the partial section of the second section adjoining the leading end amounts to 0.1 to 0.4 times the cross-section of the first section of the shank. Such a cross-sectional ratio has a favorable effect considering the mass relationship, wherein the shape of the cross section is not important. The first section of the shank can have the same or larger cross-section of the shape as compared to the shape of the trailing end.

Preferably, two steps are provided in the second section for practical as well as economic reasons.

Viewed from the mass and length ratio conditions, the passage of the shock waves is influenced positively if the length of the partial sections of the second section of the shank located between the steps corrspond expediently to 0.05 to 0.5 times the overall length of the cutter bit. In a preferred embodiment, the length of the partial section of the second section following the leading end corresponds to 0.05 to times the overall length of the cutter bit.

To avoid the development of material fractures at the steps in the cutter bit because of notch effects, the transitions at the steps are preferably provided with rounded fillets.

A circular shaped cross section provides a economic advantage especially with regard to fabrication technology, where preferably the cross-sections of the first and second sections are circularly shaped.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there illustrated and described preferred embodiments of the invention.

BRIEF DESCRIPTION OF THE DRAWING

In the drawing:

FIG. 1 is an elevational view of a cutter bit embodying the present invention;

FIG. 2 is a partial elevational view of the cutter bit shown in FIG. 1 and displayed on an enlarged scale;

FIG. 3 is elevational view of another cutter bit embodying the present invention; and FIG. 4 is a transverse sectional view taken along the line A—A in FIG. 1.

DETAILED DESCRIPTION OF THE INvENTION

In FIG. 1 a cutter bit 1 is illustrated and comprises a shank extending axially between a trailing end 2, arranged to be inserted into a tool chuck, and a leading or cutting end 5. The shank has a first axially extending section 3 of constant cross-section extending from the trailing end to a second axially extending section 4 which has a diminishing cross-section toward the leading end 5. The reduction in the cross-section of the second section 4 is effected in steps, as shown in FIG. 1 the second section has two steps 4*a*, 4*b*. The first step 4*a* is at the transition from the first section 3. The second step 4*b* is spaced axially from the first step toward the leading end 5.

In FIG. 2 the transition at the steps 4*a*, 4*b* is shown with a radiused fillet R. In FIG. 4 it can be noted that the first and second sections 3, 4 have circularly shaped cross-sections.

In FIG. 3, an axially extending cutter bit 6 is shown having a trailing end 7 arranged for insertion into a tool chuck and a leading or cutting end 8. The cross-section of the first section 9 of the shank is larger than the cross-section of the trailing end 7 of the shank. The second section 10 of the shank has a reduced or diminished cross-section as compared to the first section and is effected by two steps 10*a*, 10*b*. While in FIG. 1 the cross-section of the leading or cutting end 5 corresponds to the smaller cross-section of the second section 4, in FIG. 3, the cross-section of tbe leading or cutting end 8 is larger than the smaller cross-section of the second section 10 of the shank.

While specific embodiments of the invention have been shown and described in detail to illustrate the application of the inventive principles, it will be understood that the invention may be embodied otherwise without departing from such principles.

We claim:

1. An axially extending cutter bit comprising a trailing end for insertion into a drilling tool chuck and a leading end for effecting a cutting or chiseling operation, a shank extending axially between the trailing end and the leading end, said shank has a first axially extending section extending from the trailing end to a second axially extending section terminating at the leading end, the first section has a constant cross-section and the second section has a diminishing corss-section and the second section has a diminishing corss-section toward said leding end, wherein the improvement comprises that the cross-section of the second section diminishes in steps toward the leading end, and said second section comprises at least two partial axially extending sections formed by steps and each partial section has a constant corss-section.

2. An axially extending cutter bit, as set forth in claim 1 wherein a smaller cross-section partial section of the second section adjoining the leading end is in the range of 0.2 to 0.8 times the cross-section of the first section.

3. An axially extending cutter bit, as set forth in claim 2, wherein said second section has two steps with a first one of said steps located at the transition from the first section to the second section and a second one of said steps located spaced between said first section and said leading end.

4. An axially extending cutter bit, as set forth in claim 3, wherein the axial lenght of the first and second partial sections of said second section is each in the range of 0.05 to 0.5 tomes the overall axial extent of the cutter bit.

5. An axially extending cutter bit, as set forth in claim 4, wherein the axial lenght of the second partial section of said second section adjoining the leading end and extending twoard the tailing end is in the range of 0.05 to 0.5 times the overall axial extent of the cutter bit.

6. An axially extening cutter bit, as set forth in claim 3, wherein each of said steps has a concave radiused fillet extending in the axial direction.

7. An axially extending cutter bit, as set forth in claim 3, wherein said first section is circularly shaped transversely of the axial direction thereof.

8. An axially extending cutter bit, as set forth in claim 3, wherein said first section and said scond section are circularly shaped transversely of the axial direction thereof.

* * * * *